US009592840B2

(12) United States Patent
Okumura et al.

(10) Patent No.: US 9,592,840 B2
(45) Date of Patent: Mar. 14, 2017

(54) RAILCAR AXLE BOX SUSPENSION

(71) Applicant: KAWASAKI JUKOGYO KABUSHIKI KAISHA, Kobe-shi, Hyogo (JP)

(72) Inventors: Yasufumi Okumura, Kobe (JP); Takehiro Nishimura, Kobe (JP); Shintaro Ando, Kobe (JP); Shunichi Nakao, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 15/102,160

(22) PCT Filed: Nov. 25, 2014

(86) PCT No.: PCT/JP2014/005876

§ 371 (c)(1),
(2) Date: Jun. 6, 2016

(87) PCT Pub. No.: WO2015/083342

PCT Pub. Date: Jun. 11, 2015

(65) Prior Publication Data

US 2016/0304102 A1 Oct. 20, 2016

(30) Foreign Application Priority Data

Dec. 5, 2013 (JP) ..... 2013-252426

(51) Int. Cl.
*B61F 5/28* (2006.01)
*B61F 5/30* (2006.01)
*B61F 15/00* (2006.01)

(52) U.S. Cl.
CPC ..... *B61F 5/28* (2013.01); *B61F 5/302* (2013.01); *B61F 15/00* (2013.01)

(58) Field of Classification Search
CPC ..... B61F 5/26; B61F 5/28; B61F 5/30; B61F 5/301; B61F 5/302; B61F 5/304
See application file for complete search history.

(56) References Cited

U.S. PATENT DOCUMENTS 4,166,611 A * 9/1979 Geers ..... B61F 5/305 105/218.1
5,189,962 A * 3/1993 Iwamura ..... B61F 5/30 105/218.2

(Continued)

FOREIGN PATENT DOCUMENTS

| | | | |
|---|---|---|---|
| CN | 102673595 | A | 9/2012 |
| JP | 2007-045275 | A | 2/2007 |
| JP | 2010-184684 | A | 8/2010 |

OTHER PUBLICATIONS

Feb. 24, 2015 International Search Report issued in International Patent Application No. PCT/JP2014/005876.

(Continued)

*Primary Examiner* — Jason C Smith
(74) *Attorney, Agent, or Firm* — Oliff PLC

(57) ABSTRACT

A railcar axle box suspension includes a coupling mechanism configured to couple an axle box to a bogie frame, and the coupling mechanism includes: an axle beam including a tubular portion; a core rod inserted through the tubular portion, protruding portions being provided at both sides of the core rod; a pair of receiving seats provided at the bogie frame and including fitting grooves, the protruding portions being fitted in the fitting grooves; a pair of lid members supporting the respective protruding portions; fastening mechanisms fixing the lid members to the receiving seats; and locking members. Each of the receiving seats includes a first screw hole. Each of the lid members includes a first insertion hole and a second screw hole. Each of the fastening mechanisms includes: a first bolt; a second bolt; and a plate (Continued)

having a fitting hole and a second insertion hole, the fitting hole being fitted to a head portion of the first bolt and restricting rotation of the first bolt, a shaft portion of the second bolt being inserted through the second insertion hole. The first bolt is threadedly engaged with the first screw hole through the first insertion hole. The fitting hole of the plate is fitted to the head portion of the first bolt, and the second bolt is threadedly engaged with the second screw hole through the second insertion hole. Each of the locking members restricts rotation of the second bolt relative to the second screw hole.

8 Claims, 8 Drawing Sheets

(56) References Cited

U.S. PATENT DOCUMENTS

| | | | | |
|---|---|---|---|---|
| 8,297,199 | B2 | 10/2012 | Nishimura et al. | |
| 2005/0022689 | A1* | 2/2005 | Forbes | B61F 5/122 105/198.2 |
| 2011/0253004 | A1* | 10/2011 | Nishimura | B61F 5/325 105/220 |
| 2013/0160669 | A1* | 6/2013 | Turmeau | B61F 5/28 105/218.1 |
| 2014/0137765 | A1* | 5/2014 | Nishimura | B61F 5/52 105/182.1 |
| 2014/0261064 | A1* | 9/2014 | Wike | B61F 5/52 105/198.4 |
| 2014/0318412 | A1* | 10/2014 | East | B61F 5/28 105/218.1 |
| 2015/0344046 | A1* | 12/2015 | Nishimura | B61F 5/52 105/199.1 |
| 2015/0353105 | A1* | 12/2015 | Nishimura | B61F 5/52 105/199.1 |
| 2016/0001796 | A1* | 1/2016 | Hematian | B61F 5/06 105/200 |
| 2016/0251023 | A1* | 9/2016 | Nishimura | B61F 5/302 |

OTHER PUBLICATIONS

Jun. 7, 2016 International Preliminary Report on Patentability issued in International Patent Application No. PCT/JP2014/005876.
Feb. 24, 2015 Written Opinion issued in International Patent Application No. PCT/JP2014/005876.

* cited by examiner

RAILCAR AXLE BOX SUSPENSION

TECHNICAL FIELD

The present invention relates to a railcar axle box suspension including a coupling mechanism configured to couple an axle box to a bogie frame, the axle box accommodating a bearing supporting a wheelset.

BACKGROUND ART

In a bogie of a railcar, an axle box accommodating a bearing supporting a wheelset is supported by an axle box suspension so as to be displaceable relative to a bogie frame. There are various types of axle box suspensions. Among them, an axle beam type axle box suspension is configured such that: an axle spring constituted by a coil spring is interposed between the axle box and a side sill of the bogie frame located above the axle box; and a tip end portion of an axle beam extending from the axle box along a car longitudinal direction is supported so as to be displaceable relative to a receiving seat projecting downward from the bogie frame (see PTL 1, for example).

As shown in FIG. 12 as a specific example, in a conventional axle beam type axle box suspension 1, a core rod 5 is attached to a tubular portion 3 through an elastic bushing (axle beam supporting rubber) 4, the tubular portion 3 being located at a tip end of an axle beam 2 extending from an axle box (not shown) in a car longitudinal direction (paper surface leftward/rightward direction). A protruding portion 5*d* formed at each car width direction (paper surface vertical direction) side surface of the core rod 5 is fitted from below into a fitting groove 7*a* of a receiving seat 7 projecting downward from a side sill 6*a* of a bogie frame 6. Then, a lid member 8 is provided on a lower surface of the receiving seat 7 so as to support the protruding portion 5*d* from below and close a lower end opening of the fitting groove 7*a* and is fixed to the receiving seat 7 using two first bolts B1 and B2.

CITATION LIST

Patent Literature

PTL 1: U.S. Pat. No. 8,297,199B2

SUMMARY OF INVENTION

Technical Problem

In an axle beam type axle box suspension, an axle box is coupled to a bogie frame through an axle beam, and the axle beam swings around a core rod held by a tubular body to allow an axle spring to operate. Therefore, to allow the axle spring to satisfactorily operate, it is important to stably hold a protruding portion of the core rod in the tubular body at a position between a receiving seat and a lid member. On this account, to prevent the core rod from falling off from the tubular body, the lid member is required to be fixed to the receiving seat with high reliability.

The present invention was made in consideration of the above problem, and an object of the present invention is to provide a railcar axle box suspension capable of achieving high reliability regarding fixation between a receiving seat and a lid member.

Solution to Problem

To solve the above problem, one aspect of the present invention is a railcar axle box suspension including a coupling mechanism configured to couple an axle box to a bogie frame, the coupling mechanism including an axle beam extending from the axle box along a car longitudinal direction and including a tubular portion, the tubular portion being located at an extending direction end portion of the axle beam and being open to both sides in a car width direction, a core rod inserted through an internal space of the tubular portion and extending in the car width direction, protruding portions being provided at both respective car width direction sides of the core rod, a pair of receiving seats provided at the bogie frame and including respective fitting grooves, the protruding portions being fitted in the respective fitting grooves, a pair of lid members supporting the respective protruding portions fitted in the fitting grooves, fastening mechanisms fixing the lid members to the receiving seats, and locking members for the fastening mechanisms, the receiving seats each including a first screw hole having an inner peripheral surface, an internal thread being formed on the inner peripheral surface, the lid members each including a first insertion hole and a second screw hole having an inner peripheral surface, an internal thread being formed on the inner peripheral surface, the fastening mechanisms each including a first bolt threadedly engaged with the internal thread of the first screw hole, a second bolt threadedly engaged with the internal thread of the second screw hole, and a plate having a fitting hole and a second insertion hole, the fitting hole being fitted to a head portion of the first bolt and restricting rotation of the first bolt, a shaft portion of the second bolt being inserted through the second insertion hole, the first bolt being threadedly engaged with the first screw hole through the first insertion hole, the fitting hole of the plate being fitted to the head portion of the first bolt, and the second bolt being threadedly engaged with the second screw hole through the second insertion hole, and the locking members each restricting at least rotation of the second bolt relative to the second screw hole.

According to the above aspect of the present invention, the protruding portion of the tubular portion is located between the receiving seat and the lid member to be supported by the lid member, and the lid member is fixed to the receiving seat by the fastening mechanism. At this time, the receiving seat and the lid member are fixed to each other in such a manner that the first bolt is threadedly engaged with the first screw hole. The rotation of the head portion of the first bolt is restricted by the plate fixed to the lid member in such a manner that the second bolt is threadedly engaged with the second screw hole. The locking member configured to restrict the rotation of the second bolt relative to the second screw hole is provided for the second bolt. Therefore, even if external force such as vibration is applied to any of the first bolt and the second bolt, the first bolt is prevented from falling off from the first screw hole.

Further, the plate is fixed to the lid member in such a manner that the second bolt is threadedly engaged with the second screw hole. Therefore, it is unnecessary to fix the plate to both the lid member and the receiving seat or both the lid member and the side sill. On this account, it is possible to prevent, for example, deformation of the plate caused by a difference between vibration applied from the lid member and vibration applied from the receiving seat or the side sill during use. As a result, excellent fastening effects between the first bolt and the first screw hole and between the second bolt and the second screw hole can be maintained for a long period of time.

Advantageous Effects of Invention

The above aspect of the present invention can provide a railcar axle box suspension capable of achieving high reliability at a portion where a receiving seat and a lid member are fixed to each other.

DESCRIPTION OF EMBODIMENTS

Hereinafter, embodiments will be explained in reference to the drawings.

Embodiment 1

Figure 1:
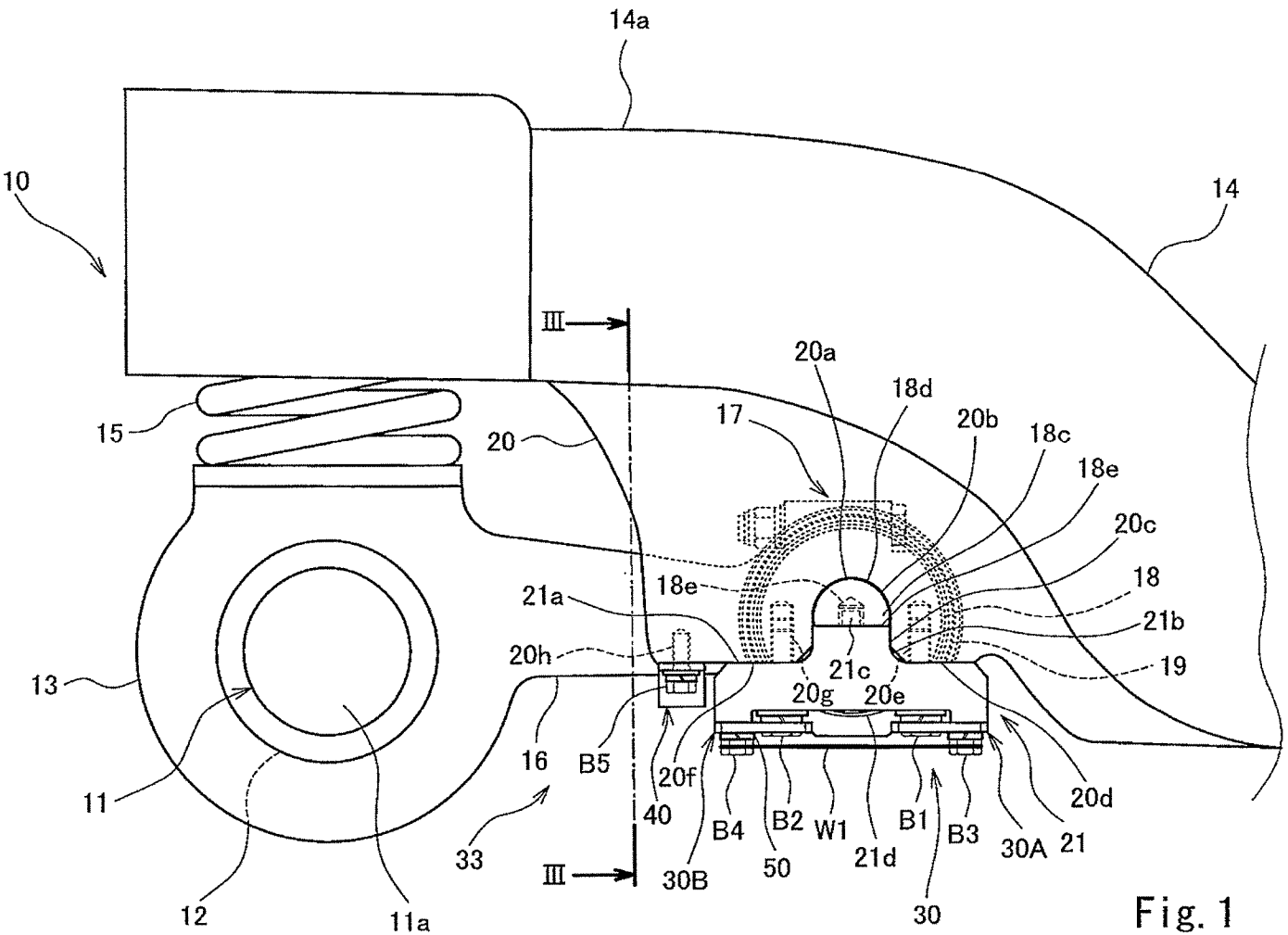
FIG. 1 is a side view showing a configuration of an axle box suspension according to Embodiment 1.
Figure 2:
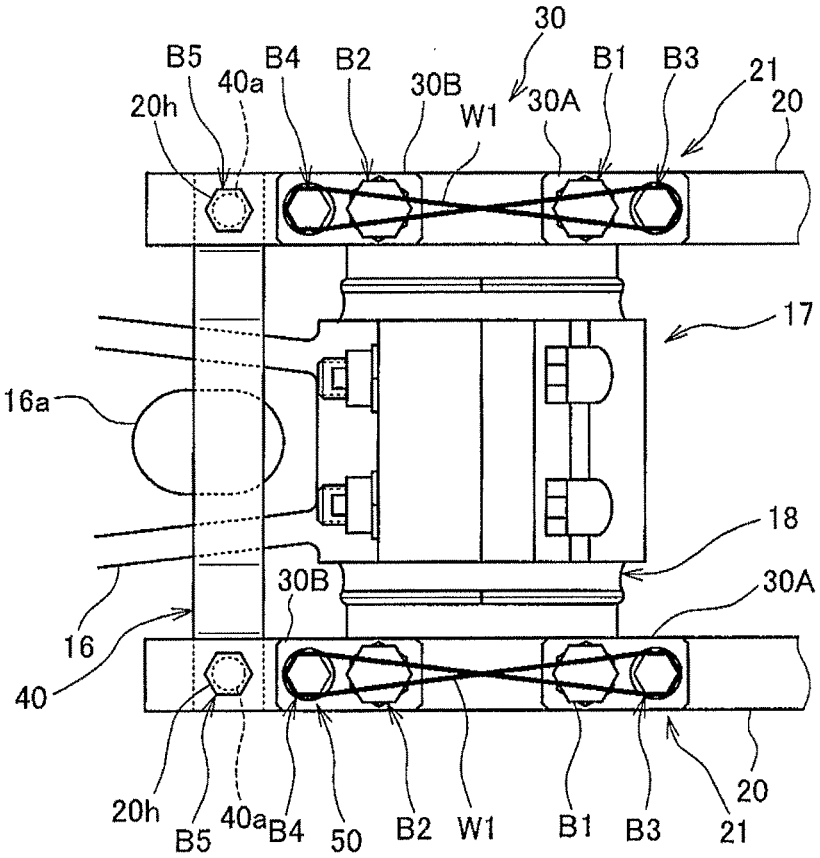
FIG. 2 is a bottom view of the axle box suspension.
Figure 3:
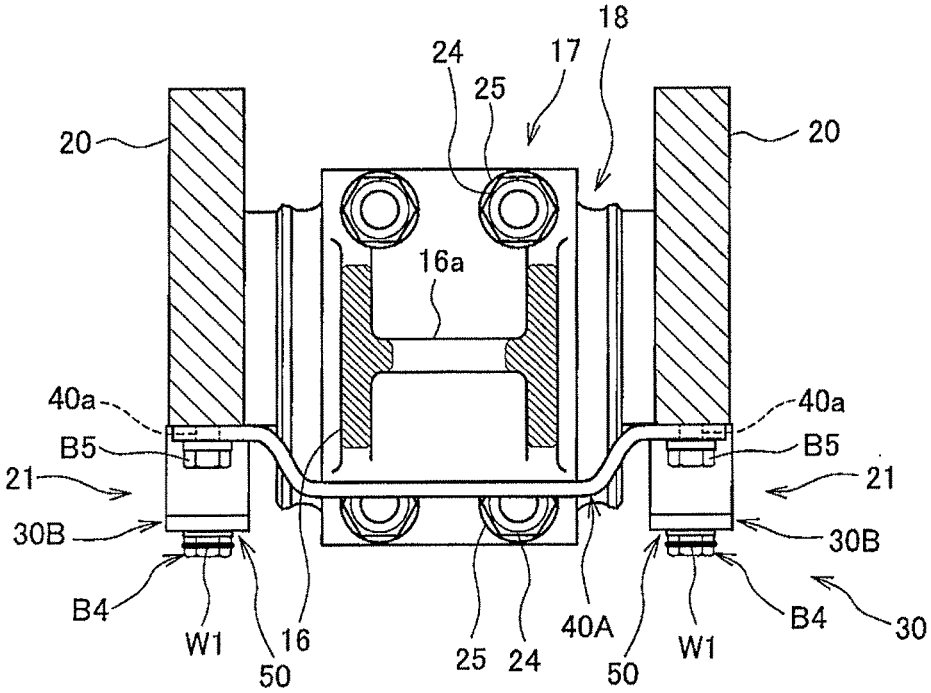
FIG. 3 is a cross-sectional view taken along line of FIG. 1.

As shown in FIGS. 1 to 3, a railcar axle box suspension 10 (hereinafter simply referred to as an "axle box suspension 10") of Embodiment 1 is an axle beam type and includes an axle box 13 accommodating a bearing 12. A wheelset 11 configured such that wheels (not shown) are attached to both respective ends of an axle 11*a* is supported by the bearing 12 so as to be rotatable at the axle 11*a*. A side sill 14*a* constituting a bogie frame 14 is located above the axle box 13. An axle spring 15 constituted by a coil spring is interposed between the axle box 13 and the side sill 14*a*.

The axle box suspension 10 includes a coupling mechanism 33. The coupling mechanism 33 includes an axle beam 16, a core rod 18, an elastic bushing 19, receiving seats 20, lid members 21, fastening mechanisms 30, a frame 40, and locking members 50. The axle box 13 is coupled to the side sill 14*a* by the coupling mechanism 33.

The axle beam 16 extends integrally from the axle box 13 along a car longitudinal direction (car traveling direction). A tubular portion 17 is provided at one extending-direction end portion of the axle beam 16. An inner peripheral surface of the tubular portion 17 has a circular tube shape, and both car width direction sides of the tubular portion 17 are open. As shown in FIGS. 2 and 3, the axle beam 16 includes a lightening hole 16*a* formed by opening a part of a car width direction middle region of the axle beam 16 in an upward/downward direction.

Figure 4:
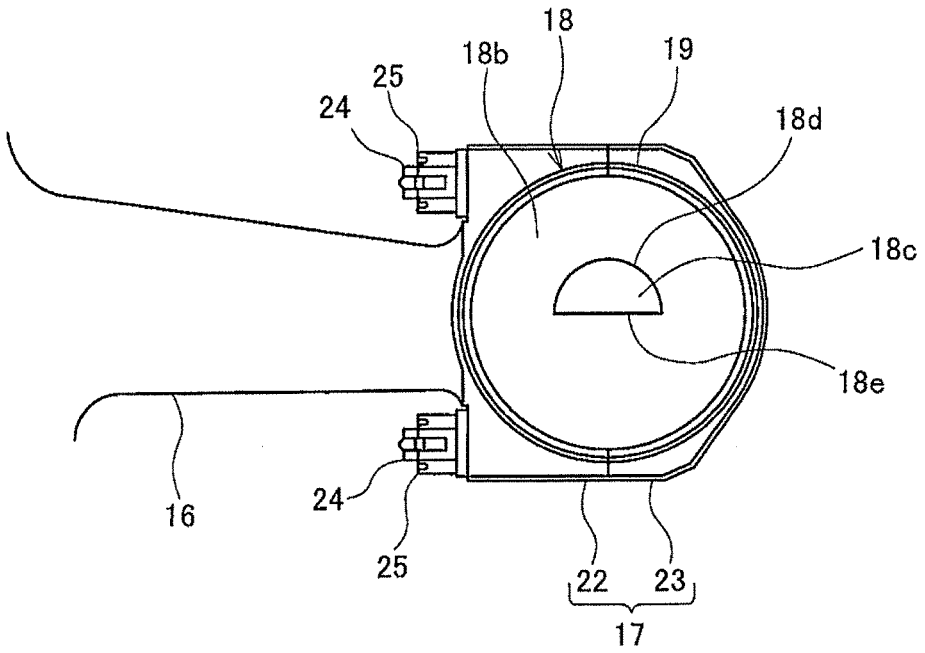
FIG. 4 is a main portion enlarged view showing a tubular portion and its periphery except for a receiving seat and a lid member in FIG. 1.
Figure 5:
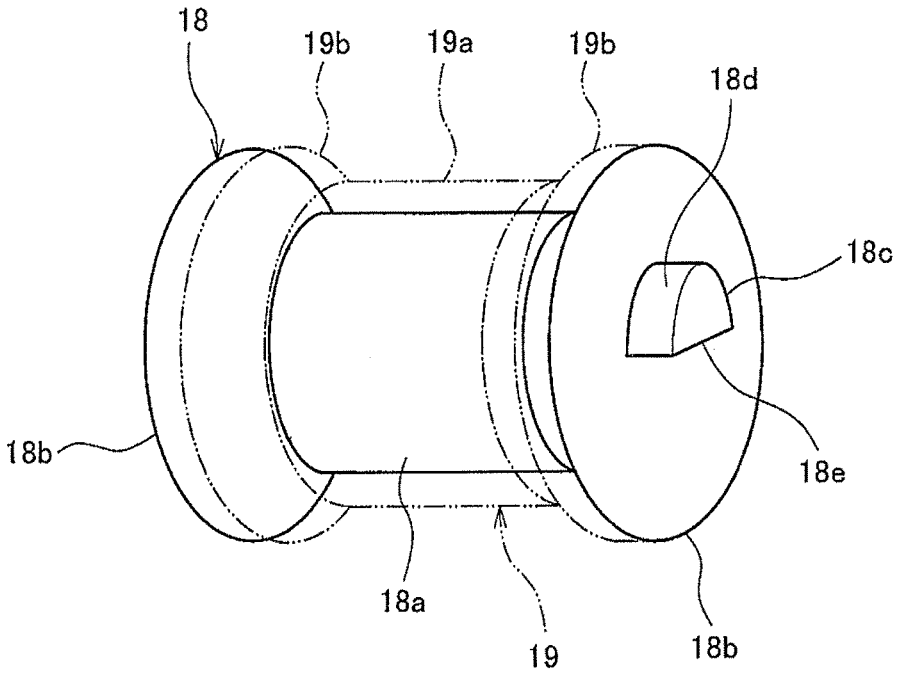
FIG. 5 is a perspective view showing a configuration of a core rod and its periphery shown in FIG. 3.

As shown in FIGS. 4 and 5, the tubular portion 17 includes a first semitubular portion 22 and a second semitubular portion 23. The first semitubular portion 22 is provided integrally with the axle beam 16, and the second semitubular portion 23 is provided so as to be separable from the first semitubular portion 22. An inner peripheral surface of the first semitubular portion 22 and an inner peripheral surface of the second semitubular portion 23 are formed so as to fit an outer peripheral surface of a circular tube portion 19*a* of the elastic bushing 19 and outer peripheral surfaces of flange portions 19*b* of the elastic bushing 19 when the first semitubular portion 22 and the second semitubular portion 23 are assembled with each other. The first semitubular portion 22 and the second semitubular portion 23 sandwich the core rod 18 via the elastic bushing 19 and are fixed to each other by screw rods 24 and nuts 25. Since the tubular portion 17 has a two-part structure as above, it becomes unnecessary to push the elastic bushing 19 into the tubular portion 17 from one side, the elastic bushing 19 being attached to a periphery of the core rod 18, and the elastic bushing 19 including the flange portions 19*b* can be easily assembled.

In the present embodiment, the tubular portion 17 is divided into two parts that are the first semitubular portion 22 and the second semitubular portion 23. However, the present embodiment is not limited to this, and the tubular portion 17 may be divided into three or more parts.

The core rod 18 is inserted through an internal space of the tubular portion 17 via the elastic bushing 19. As shown in FIGS. 4 and 5, the core rod 18 includes a circular column portion 18*a*, a pair of conical flange portions 18*b*, and protruding portions 18*c*. The flange portions 18*b* are provided at both respective car width direction sides of the circular column portion 18*a*. The protruding portions 18*c* project outward from both respective car width direction sides of the flange portions 18*b*. Each of the protruding portions 18*c* is constituted as a substantially semicircular column portion in which: an upper surface thereof is a circular-arc surface 18*d* having a substantially semicircular shape; and a lower surface continuous with lower ends of the circular-arc surface 18*d* is a flat surface 18*e*.

Lower ends of the flange portions 18*b* of the core rod 18 are located lower than a lower surface of the lid member 21. Each of minute gaps (not shown) is formed between a side surface of each flange portion 18*b* of the core rod 18 and an inner surface of each receiving seat 20. An operation of fastening first bolts B1 and B2 is easily performed by these gaps.

The elastic bushing 19 includes the circular tube portion 19*a* and the pair of conical flange portions 19*b*. The flange portions 19*b* are provided at both respective car width direction sides of the circular tube portion 19*a*. The elastic bushing 19 is externally fitted to the core rod 18 and is provided in the internal space of the tubular portion 17 together with the core rod 18. For example, the elastic bushing 19 is made of rubber. When in use of the axle box suspension 10, displacement of the tubular portion 17 relative to the core rod 18 in forward, rearward, leftward, rightward, upward, and downward directions is allowed by elasticity of the elastic bushing 19.

As shown in FIGS. 1 to 3, the pair of receiving seats 20 project downward from both respective car width direction sides of a lower surface of the side sill 14*a*. Specifically, as shown in an assembly diagram of FIG. 6 (in FIG. 6, components are shown upside down, and the protruding portion 18*c* of the core rod 18 is partially shown), the receiving seat 20 includes a fitting groove 20*a* having an inverted U shape that opens downward. The protruding portion 18*c* of the core rod 18 is fitted into the fitting groove 20*a* from below. In the receiving seat 20, lower surfaces (opposing surfaces) 20*d* and 20*f* are located at front and rear sides of the fitting groove 20*a* in the car longitudinal direction, respectively, and oppose the lid member 21. First screw holes 20*e* and 20*g* are formed on the lower surfaces 20*d* and 20*f*, respectively. An internal thread capable of being threadedly engaged with the first bolt B1 is formed on an inner peripheral surface of the first screw hole 20*e*, and an internal thread capable of being threadedly engaged with the first bolt B2 is formed on an inner peripheral surface of the first screw hole 20*g*. As shown in FIGS. 1 and 2, a third screw hole 20*h* is formed at a portion of the lower surface 20*f* of the receiving seat 20, the portion being located at the axle box 13 side of the lid member 21. An internal thread capable of being threadedly engaged with a third bolt B5 is formed on an inner peripheral surface of the third screw hole 20*h*.

Figure 6:
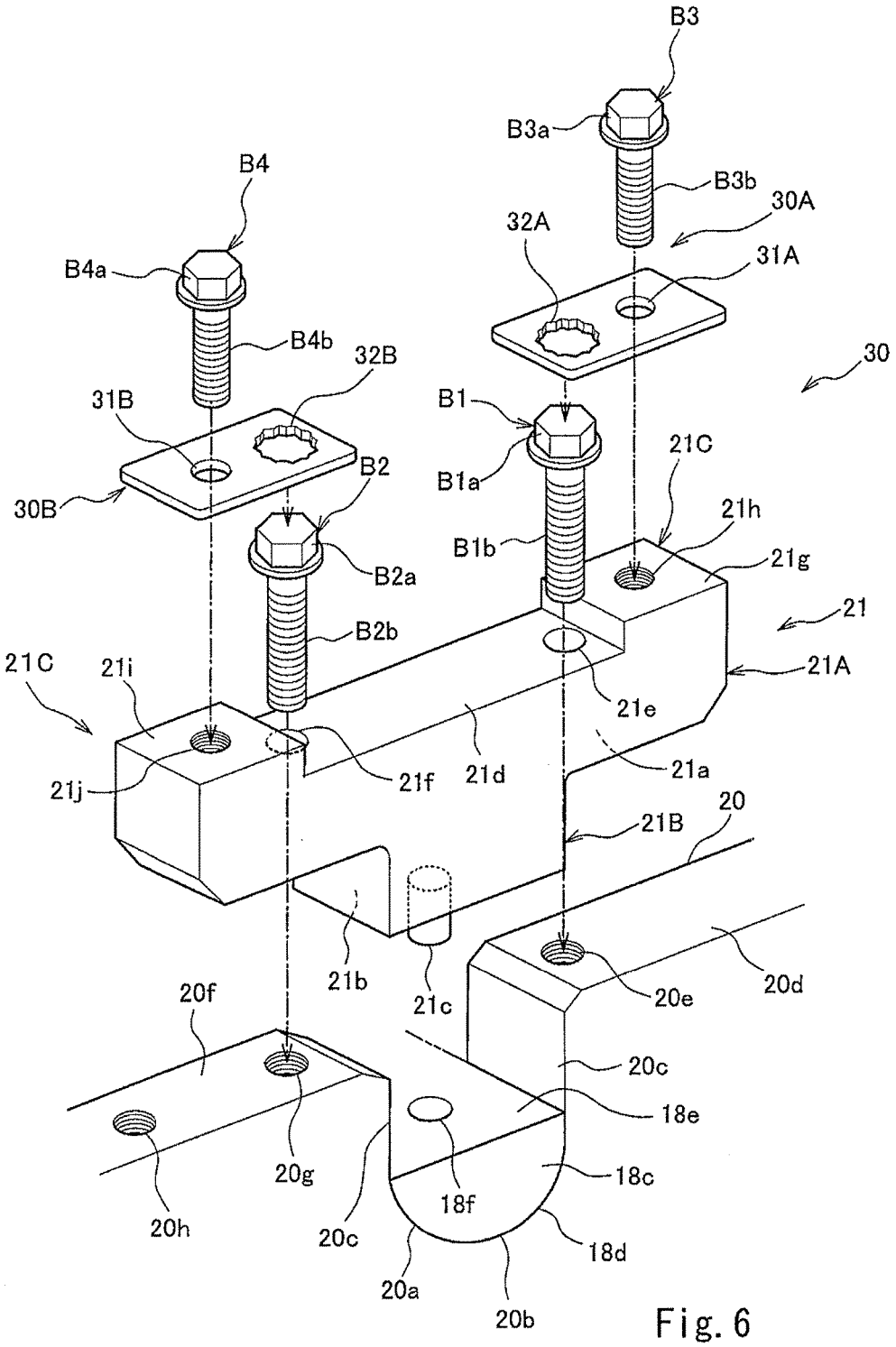
FIG. 6 is a partially perspective assembly diagram showing a configuration of the receiving seat, the lid member, and their peripheries.

As shown in FIG. 6, a length of the fitting groove 20*a* in the upward direction (depth direction) is larger than a length of the protruding portion 18*c* in the upward direction. The fitting groove 20*a* includes a circular-arc surface 20*b* and side surfaces 20*c*. The circular-arc surface 20*b* has a substantially semicircular shape and is convex upward along the circular-arc surface 18*d* of the protruding portion 18*c*. The side surfaces 20*c* extend in the upward/downward direction so as to be continuous with both respective lower ends of the circular-arc surface 20*b*. The side surfaces 20*c* are formed substantially parallel to each other.

The pair of lid members 21 are provided so as to support the respective protruding portions 18*c* fitted in the respective fitting grooves 20*a*. As shown in FIG. 6, each of the lid members 21 includes a long base portion 21A, a first projecting portion 21B, and a pair of second projecting portions 21C. The base portion 21A includes an upper surface 21*a* and a lower surface 21*d*. The first projecting portion 21B projects upward from a middle of the upper surface 21*a*. The second projecting portions 21C project downward from both respective ends of the lower surface 21*d*.

The base portion 21A is a basic part of the lid member 21 and is fixed to the receiving seat 20 along the car longitudinal direction. The base portion 21A includes first insertion holes 21*e* and 21*f* extending from the upper surface 21*a* to the lower surface 21*d*. The first insertion holes 21*e* and 21*f* are formed so as to communicate with the first screw holes 20*e* and 20*g*, respectively, when the lid member 21 is stacked on the receiving seat 20.

A columnar portion 21*c* projects from a top surface 21*b* of the first projecting portion 21B. The first projecting portion 21B contacts the protruding portion 18*c* of the core rod 18, and the columnar portion 21*c* is inserted through a positioning hole 18*f* of the core rod 18. At this time, the first projecting portion 21B supports the flat surface 18*e* of the protruding portion 18*c*. Side surfaces of the first projecting portion 21B are formed parallel to the side surfaces 20*c* of the fitting groove 20*a*.

The second projecting portions 21C include bottom surfaces 21*g* and 21*i* that are located lower than the lower surface 21*d*. A second screw hole 21*h* is formed on the bottom surface 21*g*, and an internal thread is formed on an inner peripheral surface of the second screw hole 21*h*. A second screw hole 21*j* is formed on the bottom surface 21*i*, and an internal thread is formed on an inner peripheral surface of the second screw hole 21*j*. Steps are formed between the lower surface 21*d* and the bottom surface 21*g* and between the lower surface 21*d* and the bottom surface 21*i*.

The fastening mechanism 30 includes two first bolts B1 and B2, two second bolts B3 and B4, and plates 30A and 30B.

The first bolts B1 and B2 are used to fix the lid member 21 to the receiving seat 20. The first bolts B1 and B2 are inserted through the first insertion holes 21*f* and 21*e* of the lid member 21 to be threadedly engaged with the first screw holes 20*e* and 20*g*, respectively. Thus, the first bolts B1 and B2 fix the lid member 21 to the receiving seat 20. The first bolt B1 includes a hexagonal head portion B1*a* and a shaft portion B1*b*, and the head portion B1*a* has a certain height. The first bolt B2 includes a hexagonal head portion B2*a* and a shaft portion B2*b*, and the head portion B2*a* has a certain height.

The second bolts B3 and B4 are used to stop rotations of the first bolts B1 and B2. The second bolt B3 is threadedly engaged with the second screw hole 21*h* of the lid member 21 through a second insertion hole 31A of the plate 30A, and the second bolt B4 is threadedly engaged with the second screw hole 21*j* of the lid member 21 through a second insertion hole 31B of the plate 30B. The second bolt B3 includes a hexagonal head portion B3*a* and a shaft portion B3*b*, the head portion B3*a* has a certain height. The second bolt B4 includes a hexagonal head portion B4*a* and a shaft portion B4*b*, and the head portion B4*a* has a certain height.

The plates 30A and 30B are plate bodies and are provided in surface contact with the bottom surfaces 21*g* and 21*i*, respectively. The plate 30A includes the second insertion hole 31A and a fitting hole 32A, and the plate 30B includes the second insertion hole 31B and a fitting hole 32B. The second insertion hole 31A is formed to have such an inner diameter that the shaft portion B3*b* of the second bolt B3 can be inserted through the second insertion hole 31A, and the second insertion hole 31B is formed to have such an inner diameter that the shaft portion B4*b* of the second bolt B4 can be inserted through the second insertion hole 31B. A peripheral edge shape of the fitting hole 32A is formed such that: the head portion B1*a* of the first bolt B1 is fitted in the fitting hole 32A; and the fitting hole 32A restricts the rotation of the head portion B1*a* relative to the plate 30A. A peripheral edge shape of the fitting hole 32B is formed such that: the head portion B2*a* of the first bolt B2 is fitted in the fitting hole 32B; and the fitting hole 32B restricts the rotation of the head portion B2*a* relative to the plate 30B. Specifically, the fitting hole 32A is formed to have a polygonal peripheral edge shape having a larger number of corners (twelve corners, for example) than the number of corners of the head portion B1*a* and meshes with the head portion B1*a*. The fitting hole 32B is formed to have a polygonal peripheral edge shape having a larger number of corners (twelve corners, for example) than the number of corners of the head portion B2*a* and meshes with the head portion B2*a*. Since the peripheral edge shape of each of the fitting holes 32A and 32B is formed to be such a polygonal shape that the number of corners of the peripheral edge shape is larger than the number of corners of each of the first bolts B1 and B2, an adjustment of an angle of the plate 30A around an axis of the shaft portion B1*b* and an adjustment of an angle of the plate 30B around an axis of the shaft portion B2*b* can be easily performed.

According to the fastening mechanism 30, the receiving seat 20 and the lid member 21 are stacked on each other, and the first bolts B1 and B2 are fastened. Then, the head portions B1*a* and B2*a* of the first bolts B1 and B2 are fitted in the fitting holes 32A and 32B, respectively, and the second bolts B3 and B4 are threadedly engaged with the second screw holes 21*h* and 21*j* through the second insertion holes 31A and 31B, respectively. At this time, the head portions B1*a* and B2*a* of the first bolts B1 and B2 project lower than the bottom surfaces 21*g* and 21*i*. Therefore, with the head portions B1*a* and B2*a* of the first bolts B1 and B2 fitted in the fitting holes 32A and 32B, respectively, the plates 30A and 30B are provided in surface contact with the bottom surfaces 21*g* and 21*i*, respectively. Further, the head portions B3*a* and B4*a* of the second bolts B3 and B4 project lower than the head portions B1*a* and B2*a* of the first bolts B1 and B2. The plates 30A and 30B are fixed to the lid member 21 but are not fixed to the receiving seat 20 or the side sill 14*a*.

Each of the locking members 50 is provided as a member for preventing at least the second bolts B3 and B4 from loosening relative to the second screw holes 21*h* and 21*j*. For example, the locking member 50 includes a wire lock W1 and a screw lock agent (not shown).

The wire lock W1 is constituted by a wire such as a stainless steel wire. Specifically, the wire lock W1 is wound around the head portion B3*a* of the second bolt B3 in a certain direction and is also wound around the head portion B4*a* of the second bolt B4 in a direction opposite to the certain direction. That is, in a plan view showing upper surfaces of the head portions B3*a* and B4*a*, the wire lock W1 is tightly wound so as to form a figure-8 shape.

The screw lock agent is provided between the shaft portion B3*b* of the second bolt B3 and the second screw hole 21*h* and between the shaft portion B4*b* of the second bolt B4 and the second screw hole 21*j*. The screw lock agent may be a publicly known agent, and examples thereof include an anaerobic adhesive, such as a liquid acrylic adhesive, and a vinyl acetate material. It should be noted that the use of the screw lock agent is optional and may be omitted.

When fixing the lid member 21 to the receiving seat 20 by the first bolts B1 and B2, the lid member 21 contacts the flat surface 18*e* of the protruding portion 18*c* before contacting the lower surfaces 20*d* and 20*f* of the receiving seat 20. At this time, when the first projecting portion 21B of the lid member 21 is fitted into the fitting groove 20*a* from below, and the top surface 21*b* of the first projecting portion 21B is brought into contact with the flat surface 18*e* of the protruding portion 18*c*, a slight gap is formed between the upper surface 21*a* located at both sides of the first projecting portion 21B and each of the lower surfaces 20*d* and 20*f* of the receiving seat 20. Further, at this time, gaps are formed between a tip end surface of the shaft portion B1*b* of the first bolt B1 and a terminal end surface of the first screw hole 20*e* of the receiving seat 20 and between a tip end surface of the shaft portion B2*b* of the first bolt B2 and a terminal end surface of the first screw hole 20*g* of the receiving seat 20.

In this state, the first bolts B1 and B2 are further fastened. With this, the first projecting portion 21B pushes the protruding portion 18*c* upward, so that the protruding portion 18*c* is strongly held between the fitting groove 20*a* and the first projecting portion 21B. As above, pressing force of the lid member 21 generated by fastening the first bolts B1 and B2 preferentially acts on the flat surface 18*e* of the protruding portion 18*c* rather than the lower surfaces 20*d* and 20*f* of the receiving seat 20. Further, contact pressure between the flat surface 18*e* of the protruding portion 18*c* and the top surface 21*b* of the first projecting portion 21B is higher than contact pressure between the side surface of the first projecting portion 21B and the side surface of the fitting groove 20*a*. Load acting on the core rod 18 in the car width direction is received by frictional force of the protruding portion 18*c* relative to the fitting groove 20*a* and the first projecting portion 21B.

Even if the tubular portion 17 and the core rod 18 are detached from the receiving seat 20, the frame 40 supports the axle beam 16 from below. As shown in FIGS. 1 to 3, the frame 40 is a long plate body and is bent in a crank shape such that both ends of the frame 40 are located higher than a middle portion of the frame 40. The frame 40 is fixed to the receiving seat 20 in such a manner that the third bolts B5 are threadedly engaged with the respective third screw holes 20*h* of the receiving seats 20 through insertion holes 40*a* formed on both respective ends of the frame 40. At this time, as shown in FIGS. 2 and 3, the frame 40 is provided under the axle beam 16 so as to cross the axle beam 16 in the car width direction.

According to the axle box suspension 10 configured as above, in a state where the lid member 21 is fixed to the receiving seat 20 by fastening the first bolts B1 and B2 to the first screw holes 20*e* and 20*g*, the head portions B1*a* and B2*a* of the first bolts B1 and B2 mesh with the fitting holes 32A and 32B of the plates 30A and 30B for locking, respectively, and the plates 30A and 30B are fixed to the lid member 21 by the second bolts B3 and B4. Therefore, loosening of the first bolts B1 and B2 during use can be prevented by the plates 30A and 30B and the second bolts B3 and B4.

In the axle box suspension 10, the second bolts B3 and B4 are threadedly engaged with the lid member 21 with the locking member 50 provided. With this, even if external force such as vibration is applied to any of the first bolts B1 and B2 and the second bolts B3 and B4, the first bolts B1 and B2 are prevented from loosening and falling off from the lid member 21. Specifically, the following various effects can be expected by an axle beam retaining mechanism using the fastening mechanism 30 and the locking member 50.

Figure 7:
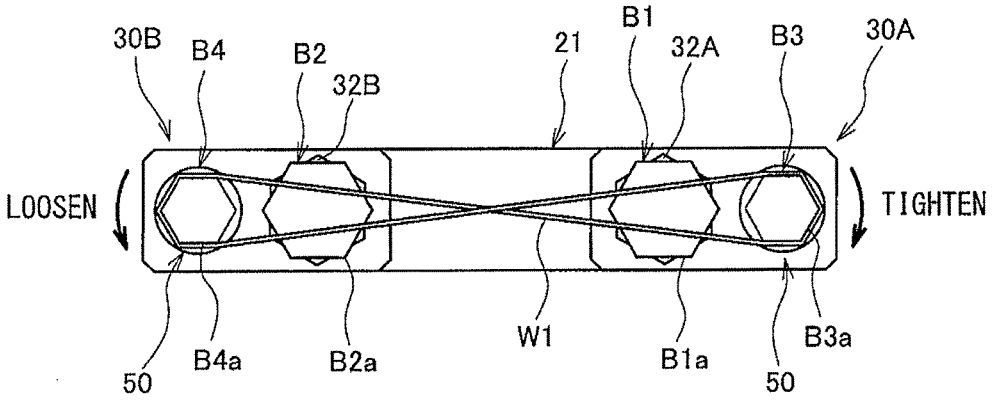
FIG. 7 is a configuration diagram showing a wire lock and its periphery for showing an effect of Embodiment 1.
Figure 8:
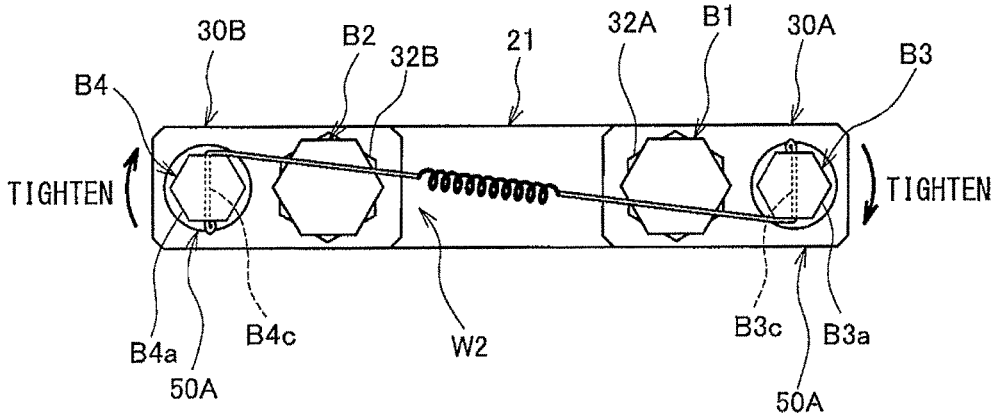
FIG. 8 is a configuration diagram showing the wire lock and its periphery for showing a configuration of Embodiment 2.

As shown in FIG. 2, in the axle box suspension 10, the wire lock W1 is provided as the locking member 50 so as to be tightly wound in a figure-8 shape around the head portions B3*a* and B4*a* of the adjacent two second bolts B3 and B4. With this, as shown in FIG. 7 for example, if vibration or the like is applied to the second bolt B4, and the second bolt B4 rotates in a loosening direction, force in a fastening direction is applied to the second bolt B3. As above, by adopting the wire lock W1, the effect of the locking member 50 can be obtained by the cooperation of the second bolts B3 and B4. As a result, fastened states of the first bolts B1 and B2 can be maintained.

Further, in the axle box suspension 10, the screw lock agent as the locking member 50 is provided at least between the shaft portion B3*b* of the second bolt B3 and the second screw hole 21*h* and between the shaft portion B4*b* of the second bolt B4 and the second screw hole 21*j*. With this, a measure to prevent the loosening of the second bolts B3 and B4 is being taken. Thus, the fastened states of the first bolts B1 and B2 can be further maintained.

Furthermore, in the axle box suspension 10, the plates 30A and 30B are not directly fixed to the receiving seat 20 but are directly fixed to the lid member 21 using the second bolts B3 and B4 and the second screw holes 21*h* and 21*j* independently from the receiving seat 20. Therefore, it is possible to prevent, for example, deformation of the plates 30A and 30B caused by a difference between vibration applied from the lid member 21 to the plates 30A and 30B and vibration applied from the receiving seat 20 or the side sill 14*a* to the plates 30A and 30B during use. As a result, the excellent fastened states of the first bolts B1 and B2 can be maintained for a long period of time.

Further, the second bolts B3 and B4 project lower than the first bolts B1 and B2, and a part or more of the head portion B1*a* of the first bolt B1 and a part or more of the head portion B2*a* of the first bolt B2 are embedded in the fitting holes 32A and 32B of the plates 30A and 30B, respectively. Therefore, even if an object collides with the lid member 21 or its periphery from below, the object hardly collides with the first bolts B1 and B2. With this, the fastening between the first bolt B1 and the first screw hole 20*e* and the fastening between the first bolt B2 and the first screw hole 20*g* can be satisfactorily maintained.

In the axle box suspension 10, the frame 40 is provided at the receiving seats 20 so as to be located under the axle beam 16 and cross the axle beam 16 in the car width direction. Therefore, even if all of the fastening mechanisms 30 and the pair of lid members 21 fall off, and the tubular portion 17 of the axle beam 16 and the core rod 18 are detached from the receiving seats 20, the axle beam 16 is supported by the frame 40 from below. On this account, the axle beam 16 can be prevented from falling onto a railway track or the like. Since the position of the axle beam 16 is restricted between the pair of receiving seats 20, the position of the axle beam 16 in the car width direction can be maintained to some extent. With this, the railcar can maintain its standing state, so that an effect of allowing quick rescue activity is obtained.

Hereinafter, differences between Embodiment 1 and each of other embodiments of the present invention will be mainly explained.

Embodiment 2

FIG. 8 is a diagram showing the configuration of a wire lock W2 of Embodiment 2 and corresponds to FIG. 7. Embodiment 2 adopts the wire lock W2 of a diagonal cross shape. Specifically, through holes B3*c* and B4*c* are formed so as to cross insides of the head portions B3*a* and B4*a* of the second bolts B3 and B4, respectively, and both end portions of a wire including a coil spring biased in a compression direction are inserted through and fixed to the through holes B3*c* and B4*c*, respectively. The wire lock W2 is provided in a diagonal cross shape in such a direction that the second bolts B3 and B4 are fastened.

According to Embodiment 2 configured as above, the second bolts B3 and B4 are biased in a fastening direction by the wire lock W2 at all times. Therefore, the loosening of the second bolts B3 and B4 is prevented, so that the same effects as in Embodiment 1 can be expected.

Embodiment 3

Figure 9:
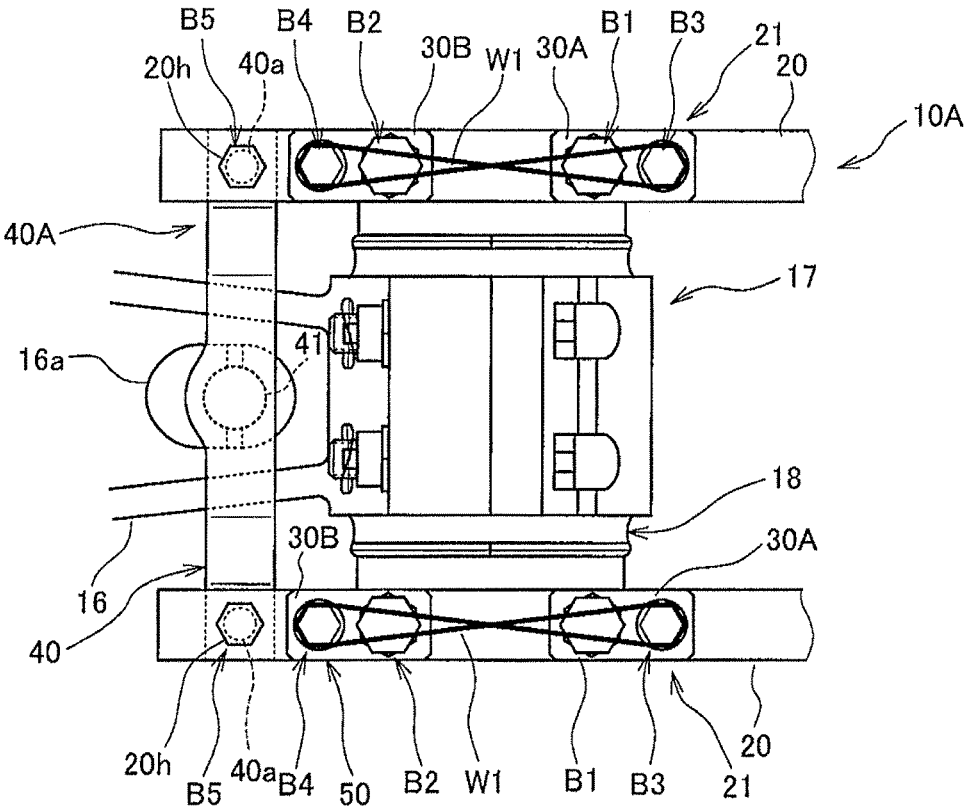
FIG. 9 is a bottom view of the axle box suspension for showing a configuration of Embodiment 3.
Figure 10:
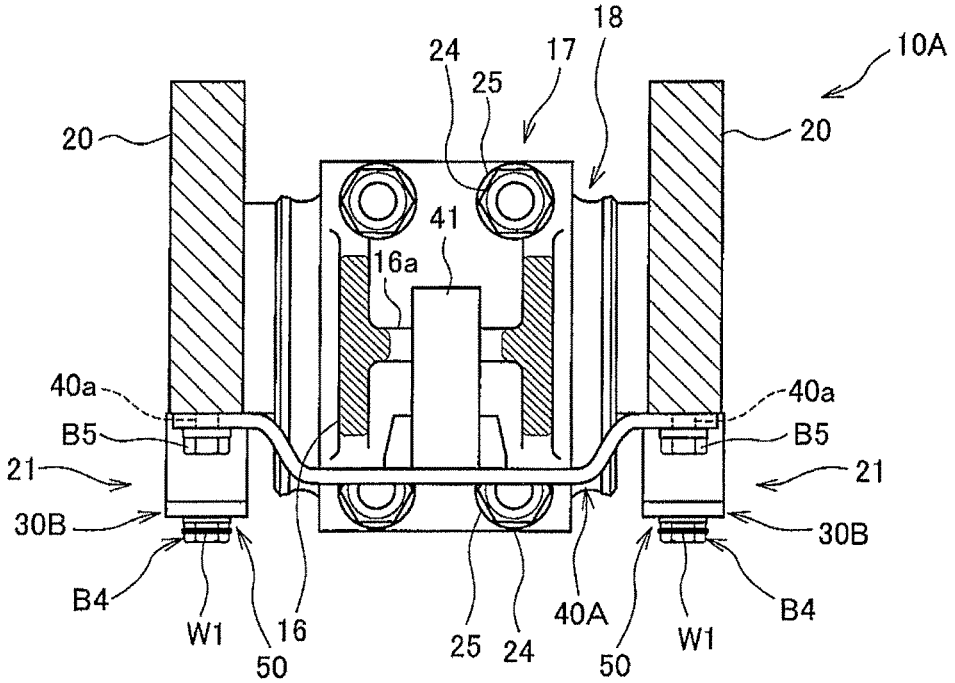
FIG. 10 is a diagram corresponding to FIG. 3 and showing a positional relation between a columnar portion and an axle beam in Embodiment 3.

FIGS. 9 and 10 are diagrams each showing a configuration of the tubular portion 17 and its periphery according to Embodiment 3 and correspond to FIGS. 2 and 3, respectively.

As shown in FIGS. 9 and 10, in an axle box suspension 10A of Embodiment 3, a columnar portion 41 stands at a middle of a frame 40A. The columnar portion 41 is inserted through the lightening hole (third insertion hole) 16*a* of the axle beam 16.

The axle box suspension 10A of Embodiment 3 configured as above has an effect in which as with Embodiment 1, even if all of the fastening mechanisms 30 and the pair of lid members 21 fall off, and the tubular portion 17 of the axle beam 16 and the core rod 18 are detached from the receiving seats 20, the axle beam 16 is supported by the frame 40A from below. Further, since the columnar portion 41 is inserted through the lightening hole 16*a* of the axle beam 16 at this time, a relative movement between the axle beam 16 and the side sill 14*a* in a horizontal direction is restricted. Therefore, the position of the axle beam 16 relative to the side sill 14*a* is satisfactorily maintained, so that the effect of allowing quick rescue activity is further obtained.

Embodiment 4

Figure 11:
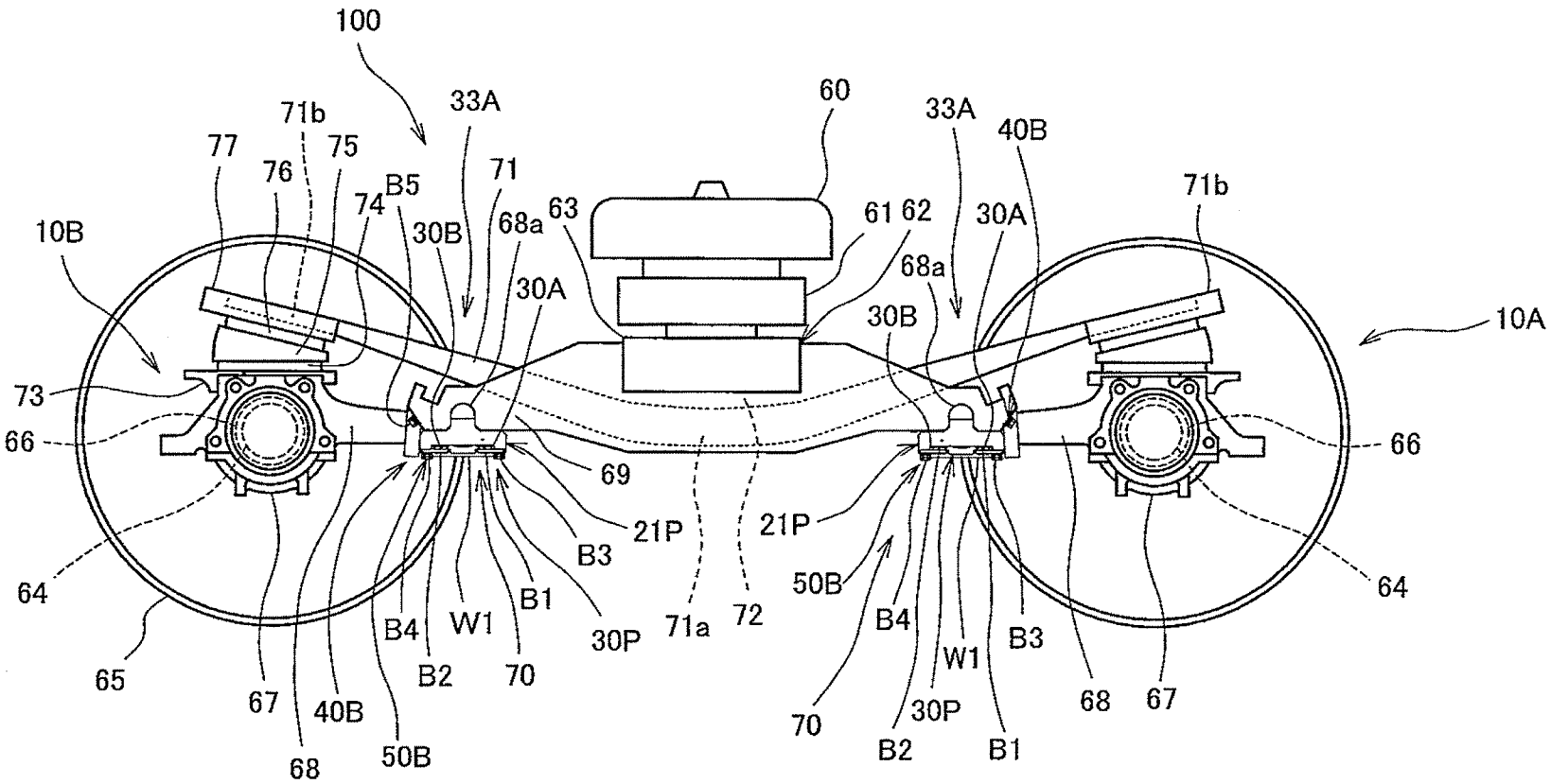
FIG. 11 is a side view showing a configuration of a bogie and the axle box suspension in Embodiment 4.
Figure 12:
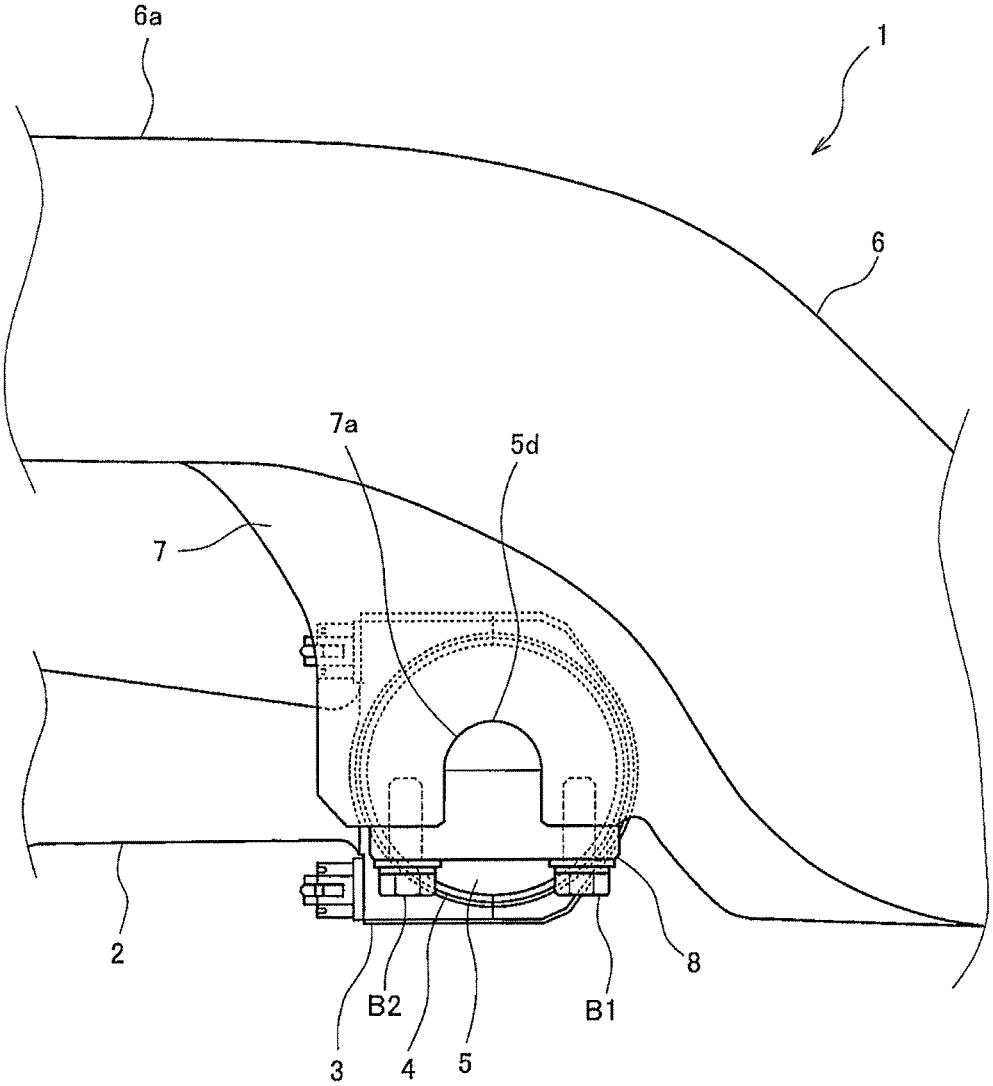
FIG. 12 is a side view showing a configuration of an axle box suspension 1 of a conventional example.

FIG. 11 is a side view of a bogie 100 including an axle box suspension 10B according to Embodiment 4. The bogie 100 includes a bolster 61 and a bogie frame 62. The bolster 61 supports a carbody (not shown) through an air spring 60 that is a secondary suspension. The bogie frame 62 supports the bolster 61 such that the bolster 61 is rotatable relative to the bogie frame 62 in a yawing direction. The bogie frame 62 includes a cross beam 63 but does not include a so-called side sill. The cross beam 63 is located at a middle of the bogie 100 in the car longitudinal direction and extends in a crosswise direction (car width direction). Axles 64 each extending in the crosswise direction are provided in front of and behind the cross beam 63. Wheels 65 are provided at both crosswise direction ends of each axle 64. Bearings 66 rotatably supporting the axle 64 are provided at both crosswise direction end portions of the axle 64 so as to be located outside the wheels 65 in the crosswise direction. The bearings 66 are accommodated in respective axle boxes 67.

The axle box suspension 10B includes a coupling mechanism 33A. The axle boxes 67 are elastically coupled to both car width direction end portions of the cross beam 63 by the coupling mechanisms 33A. The coupling mechanism 33A includes an axle beam 68, a pair of receiving seats 69, and a coupling portion 70. The axle beam 68 projects integrally from the axle box 67 toward the cross beam 63. The pair of receiving seats 69 project from the cross beam 63 toward the axle beam 68 and are lined up with an interval in the crosswise direction. The coupling portion 70 elastically couples a tip end portion of the axle beam 68 to the receiving seats 69. The coupling portion 70 includes a lid member 21P, a fastening mechanism 30P, a frame 40B, and a locking member 50B. The lid member 21P, the fastening mechanism 30P, and the locking member 50B are the same in configuration as the lid member 21, the fastening mechanism 30, and the locking member 50, respectively. A protruding portion 68*a* of a core rod (not shown) sandwiched by a tip end of the axle beam 68 is supported between the receiving seat 69 and the lid member 21P. As with the frame 40, the frame 40B is provided so as to be located under the axle beam 68 and cross the axle beam 68 in the car width direction and is fixed to the pair of receiving seats 69 by the third bolts B5.

Each of plate springs 71 extending in the car longitudinal direction is provided between the cross beam 63 and the axle box 67. Longitudinal direction middle portions 71*a* of the plate springs 71 support both respective crosswise direction end portions of the cross beam 63 from below. Both longitudinal direction end portions 71*b* of each of the plate springs 71 are supported by the respective axle boxes 67 from below. To be specific, each of the plate springs 71 serves as both a primary suspension and a conventional side sill. The plate springs 71 are made of, for example, fiber-reinforced resin. Each of the middle portions 71*a* of the plate springs 71 is provided between the pair of receiving seats 69 so as to extend under the cross beam 63. Pressing members 72 are provided under both respective crosswise direction end portions of the cross beam 63, and each of the pressing members 72 includes a lower surface having a circular-arc shape in a side view. The lower surface of the pressing member 72 is placed on the middle portion 71*a* of the plate spring 71. To be specific, the pressing members 72 press the respective middle portions 71*a* of the plate springs 71 downward by a downward load (such as a carbody load), transmitted from the cross beam 63, so as not to fix the plate spring 71 in the upward/downward direction.

An axle box cover 73, a first vibrationproof rubber unit 74, a wedge-shaped member 75, a second vibrationproof rubber unit 76, and a spring seat 77 are stacked above the axle box 67 in this order from a lower side. The end portion 71*b* of the plate spring 71 is place on the spring seat 77 from above through an elastic sheet (rubber sheet), not shown. The middle portion 71*a* of the plate spring 71 is pressed downward by the pressing member 72. In a side view, the plate spring 71 is formed in a bow shape that is convex downward.

The same effects as in Embodiment 1 can be expected in Embodiment 4 configured as above. To be specific, in a state where the protruding portion 68*a* is located between the receiving seat 69 and the lid member 21P to be supported by the lid member 21P, the lid member 21P is fixed to the receiving seats 69 by the fastening mechanism 30P. The receiving seats 69 and the lid member 21P are fixed to each other in such a manner that the first bolts B1 and B2 are threadedly engaged with the first screw holes. The rotations of the head portions of the first bolts B1 and B2 are restricted by the plates 30A and 30B fixed to the lid member 21P in such a manner that the second bolts B3 and B4 are threadedly engaged with the second screw holes. The locking member configured to restrict the rotations of the second bolts B3 and B4 relative to the second screw holes is provided for the second bolts B3 and B4. Even if external force such as vibration is applied to any of the first bolts B1 and B2 and the second bolts B3 and B4, the first bolts B1 and B2 are prevented from falling off from the first screw holes. Therefore, the lid member 21P can be fixed to the receiving seats 69 with high reliability.

The plates 30A and 30B are fixed to the lid member 21P in such a manner that the second bolts B3 and B4 are threadedly engaged with the second screw holes. Therefore, even in the case of a bogie not including side sills, the lid member 21P can be fixed by providing a pair of receiving seats, without modifying the plates 30A and 30B of Embodiments 1 to 3. On this account, it is possible to prevent, for example, deformation of the plates 30A and 30B caused by a difference between vibration applied from the lid member 21P to the plates 30A and 30B and vibration applied from the cross beam 63 to the plates 30A and 30B.

As above, the present embodiment is not limited to a configuration in which the axle box is coupled to the side sill 14*a* by the coupling mechanism 33 as in Embodiment 1. Each of the embodiments has explained the axle beam type axle box suspension. However, the present invention is applicable to various types of axle box suspensions.

Others

The present invention is not limited to the above embodiments, and modifications, additions, and eliminations may be made within the scope of the present invention. The above embodiments may be combined arbitrarily. For example, a part of components in one embodiment may be applied to another embodiment.

In each of the above embodiments, the screw lock agent is provided between the shaft portion B3*b* of the second bolt B3 and the second screw hole 21*h* and between the shaft portion B4*b* of the second bolt B4 and the second screw hole 21*j*. However, the present invention is not limited to this. The screw lock agent may be provided only between the shaft portion B1*b* of the first bolt B1 and the first screw hole 20*e* and between the shaft portion B2*b* of the first bolt B2 and the first screw hole 20*g*. Or, the screw lock agent may be provided at all of these.

The wire lock (W1 or W2) is not essential. Any one of the wire lock (W1 or W2) or the screw lock agent may be provided, or both the wire lock (W1 or W2) and the screw lock agent may be provided.

The number of first bolts and the number of second bolts are not limited. Needless to say, as the number of first bolts and the number of second bolts increase, the lid member can be more effectively prevented from falling off from the receiving seat. It is preferable to use two or more second bolts for each lid member. This is because in such a case, the wire lock W1 or W2 in Embodiment 1 or 2 can be provided.

The present invention is not limited to a configuration in which two plates are used for each lid member. Three or more plates may be used, or only one plate may be used. For example, the plates 30A and 30B may be replaced with a single continuous plate.

The present invention is not limited to a configuration in which the frame (40 or 40A) is fixed to the axle beam 16 by the third bolts B5. For example, the frame (40 or 40A) may be fixed to the axle beam 16 by welding. The shape of the frame (40 or 40A) is not limited to a plate shape and may be a pipe shape, a shaft shape, a ladder shape, or the like.

INDUSTRIAL APPLICABILITY

As above, the present invention has an excellent effect of being able to provide a railcar axle box suspension capable of achieving high reliability at a portion where a receiving seat and a lid member are fixed to each other. Therefore, it is useful to widely apply the present invention to railcar axle box suspensions which can achieve the significance of this effect.

REFERENCE SIGNS LIST

B1, B2 first bolt
B3, B4 second bolt
B5 third bolt
B1*a* to B4*a* head portion of bolt
B1*b* to B4*b* shaft portion of bolt
W1 wire lock (figure-8 shaped lock)
W2 wire lock (diagonal cross shaped lock)
1, 10, 10A, 10B axle box suspension
2, 16, 68 axle beam
3, 17, 68*a* tubular portion
4, 19 elastic bushing
5, 18 core rod
18*c*, 68*a* protruding portion
6*a*, 14*a* side sill
7, 20, 69 receiving seat
7*a*, 20*a* fitting groove
8, 21, 21P lid member
13, 67 axle box
16, 68 axle beam
20*e*, 20*g* first screw hole
20*h* third screw hole
21A base portion
21B first projecting portion
21C second projecting portion
21*a* upper surface

21*c* columnar portion
21*d* lower surface
21*e*, 21*f* first insertion hole
21*g*, 21*i* bottom surface
21*h*, 21*j* second screw hole
30, 30P fastening mechanism
30A, 30B plate
31A, 31B second insertion hole
32A, 32B fitting hole
33, 33A coupling mechanism
40, 40A, 40B frame
41 columnar portion
50, 50B locking member
63 cross beam
70 coupling portion
71 plate spring

The invention claimed is:

1. A railcar axle box suspension comprising a coupling mechanism configured to couple an axle box to a bogie frame, the coupling mechanism including an axle beam extending from the axle box along a car longitudinal direction and including a tubular portion, the tubular portion being located at an extending direction end portion of the axle beam and being open to both sides in a car width direction, a core rod inserted through an internal space of the tubular portion and extending in the car width direction, protruding portions being provided at both respective car width direction sides of the core rod, a pair of receiving seats provided at the bogie frame and including respective fitting grooves, the protruding portions being fitted in the respective fitting grooves, a pair of lid members supporting the respective protruding portions fitted in the fitting grooves, fastening mechanisms fixing the lid members to the receiving seats, and locking members for the fastening mechanisms, the receiving seats each including a first screw hole having an inner peripheral surface, an internal thread being formed on the inner peripheral surface, the lid members each including a first insertion hole and a second screw hole having an inner peripheral surface, an internal thread being formed on the inner peripheral surface, the fastening mechanisms each including a first bolt threadedly engaged with the internal thread of the first screw hole, a second bolt threadedly engaged with the internal thread of the second screw hole, and a plate having a fitting hole and a second insertion hole, the fitting hole being fitted to a head portion of the first bolt and restricting rotation of the first bolt, a shaft portion of the second bolt being inserted through the second insertion hole, the first bolt being threadedly engaged with the first screw hole through the first insertion hole, the fitting hole of the plate being fitted to the head portion of the first bolt, and the second bolt being threadedly engaged with the second screw hole through the second insertion hole, and the locking members each restricting at least rotation of the second bolt relative to the second screw hole.

2. The railcar axle box suspension according to claim 1, wherein:

the second bolt of each of the fastening mechanisms comprises a plurality of second bolts;

each of the locking members includes a wire lock provided at a head portion of one of the second bolts and a head portion of the other second bolt.

3. The railcar axle box suspension according to claim 2, wherein the wire lock includes a wire wound around the head portion of one of the adjacent two second bolts in one direction and also wound around the head portion of the other second bolt in a direction opposite to the one direction.

4. The railcar axle box suspension according to claim 1, wherein:

each of the lid members includes a base portion having an upper surface and a lower surface, a first projecting portion projecting upward from the upper surface and contacting the protruding portion, and a second projecting portion projecting lower than the lower surface and having a bottom surface located lower than the lower surface;

the first insertion hole is formed on the lower surface;

the second screw hole is formed on the bottom surface;

the head portion of the first bolt projects lower than the bottom surface;

with the head portion of the first bolt fitted in the fitting hole, the plate is provided in surface contact with the bottom surface, and a head portion of the second bolt projects lower than the head portion of the first bolt.

5. The railcar axle box suspension according to claim 4, wherein:

the base portion is long and is fixed to the receiving seat along the car longitudinal direction; and the second projecting portion comprises a pair of second projecting portions located at both respective ends of the base portion.

6. The railcar axle box suspension according to claim 1, wherein the first screw hole of each of the receiving seats comprises first screw holes located at respective positions of lower surfaces of the receiving seat, the lower surfaces being located at respective front and rear sides of the fitting groove in the car longitudinal direction and opposing the lid member.

7. The railcar axle box suspension according to claim 1, further comprising a frame located lower than the axle beam, crossing the axle beam along the car width direction, and fixed to the receiving seats.

8. The railcar axle box suspension according to claim 7, wherein:

a third insertion hole is formed on the axle beam; and the frame includes a columnar portion inserted through the third insertion hole.

* * * * *